US005372079A

United States Patent [19]

Kitai et al.

[11] Patent Number: 5,372,079

[45] Date of Patent: Dec. 13, 1994

[54] THREAD TRIMMING DEVICE FOR A SEWING MACHINE

[75] Inventors: Koji Kitai; Takanori Nakayama, both of Tochigi, Japan

[73] Assignee: The Singer Company N.V., Curacao, Netherlands Antilles

[21] Appl. No.: 104,702

[22] Filed: Aug. 11, 1993

[51] Int. Cl.[5] ..... D05B 65/00

[52] U.S. Cl. ..... 112/291

[58] Field of Search ..... 112/285, 291, 293, 296, 112/300

[56] References Cited

U.S. PATENT DOCUMENTS

| | | | |
|---|---|---|---|
| 4,365,568 | 12/1982 | Ross | 112/291 |
| 4,401,045 | 8/1983 | Russell | 112/300 X |
| 4,586,449 | 5/1986 | Raupach | 112/300 X |

*Primary Examiner*—Clifford D. Crowder
*Assistant Examiner*—Paul C. Lewis

[57] ABSTRACT

A thread trimming device for a sewing machine in which a movable knife coupled to a thread trimmer lever by way of a link mechanism is turned to cut sewing threads in cooperation with a fixed knife, the first projection of the thread trimmer lever engaging in the cam groove of a thread trimmer cam, comprises a thread trimmer positive motion bracket having a second projection capable of engaging in the positive motion cam groove of a thread trimmer positive motion cam so as to keep the engagement of the first projection with the cam groove after the second projection thereof engages the positive motion cam groove until it is disengaged therefrom. Since the time of completing the thread trimming can be set by the positive motion cam groove of the thread trimmer positive motion cam, the timing of the thread trimming can be adjusted with certainty. Furthermore, the operating time of the driving means can be remarkably reduced.

1 Claim, 5 Drawing Sheets

THREAD TRIMMING DEVICE FOR A SEWING MACHINE

BACKGROUND OF THE INVENTION

1. Field of the Invention

The present invention relates to a thread trimming device for a sewing machine.

2. Description and Problems of the Related Art

There is known a conventional thread trimming device for a sewing machine which cuts needle and bobbin threads by reciprocating a movable knife coupled to a thread trimmer which has a projection engaging a cam surface of a thread trimmer cam fixed to a hook driving shaft provided under the bed of the sewing machine, the hook driving shaft rotating in synchronism with the arm shaft of the sewing machine. In such a thread trimming device, a needle is stopped at the position adjacent to the lower dead point thereof (point A in FIG. 9), the, a rotary solenoid provided adjacent to the thread trimmer cam is operated forward (point B in FIG. 9) to let the cam roller of the trimmer lever engage the cam groove of the thread trimmer cam, so as to reciprocate the movable knife by way of a link mechanism coupled to the thread trimmer lever which moves along the above mentioned cam groove for cutting the needle and bobbin threads in cooperation with a fixed knife. After the completion of cutting the threads by the movable and fixed knives, the rotary solenoid is operated backward to separate the cam roller of the thread trimmer lever from the cam groove of the thread trimmer cam so as to complete the operation of trimmer the threads. In such a conventional thread trimming device for a sewing machine, the adjustment of tinting of completing the thread trimming is a time-consuming and troublesome work since the arm shaft is turned little after the time (point K in FIG. 9) when the thread trimming is completed (that is, when the threads are cut, the movable knife is returned to its rest position by way of the thread trimmer cam and moreover the rotary solenoid is deenergized) until the time when the needle is stopped at the upper stop position (point H in FIG. 9).

When the thread trimming is adjusted too early, there occurs the troubles of;

(1) mistrimming of threads; or (2) the interruption of sewing since the needle thread pulls out of the throat when sewing is resumed as the throat thread end remains short at the needle point due to the rising of the thread take-up lever after the completion of the thread trimming. While the thread trimming is adjusted too late, there occurs the troubles in handling cloths etc. when sewing is completed since the needle is stopped (point H in FIG. 9) after the thread take-up lever passes the upper dead point thereof corresponding to the correct upper stop position of the needle and consequently the needle is stopped at the position too close to the needle plate.

Moreover, the rotary solenoid has to be energized during the time between points B and K in FIG. 9 so as to continue the operation of the rotary solenoid for a long time, resulting in the waste of energy. At point B an operator operates a pedal to supply a thread cutting instruction to the sewing machine, which starts rotation at a low speed and the rotary solenoid starts a forward operation upon reception of the instruction.

SUMMARY OF THE INVENTION

The present invention has been made from a viewpoint of such technical problems to provide a thread trimming device for a sewing machine comprising a needle which vertically reciprocates through a throat plate attached to the sewing machine bed 21, a hook 15 which forms stitch cooperating with the needle, a movable knife 3 and a fixed knife 16 which are provided adjacent to the hook 15, wherein the movable knife 3 cuts the sewing threads in cooperation with the fixed knife 16 as the movable knife 3 coupled to the thread trimmer lever 10 by way of a link mechanism (11, 18, 17) is operated since the projection 10*b* of the thread trimmer lever 10 engages in the cam groove 2*a* of a thread trimmer cam 2, characterized in that the thread trimming device further comprises a hook driving shaft I which is provided under the sewing machine bed 21 and rotates in synchronism with the arm shaft of the sewing machine together with the thread trimmer cam 2 and a thread trimmer positive motion cam 4 coaxially fixed thereto, a thread trimmer positive motion bracket 9 which is supported by a guide shaft 8 provided on the side of the sewing machine bed 21 in such a way as to be movable along the axial direction of the guide shaft 8 and has a cam roller 10*b* capable of engaging in the positive motion cam groove 4*b* of the thread trimmer positive motion cam 4, and which is biased to disengage the projection 9*c* thereof from the positive motion cam groove 4*b*, a thread trimmer lever 10 which has a projection 10*b* capable of engaging the cam groove 2*a* of the thread trimmer cam 2 and interlocks with the movement of the thread trimmer positive motion bracket 9 in the axial direction of the guide shaft 8, and which is rotatably supported on the side of the sewing machine bed 21 and a driving means 5 for displacing the thread trimmer positive motion bracket 9 in the axial direction of the guide shaft 8 so as to engage the projection 9*c* of the thread trimming positive motion bracket 9 in the positive motion cam groove 4*b* so as to keep the projection 10*b* of the thread trimmer lever 10 engaged in the cam groove 2*a* of the thread trimmer cam 2 after the projection 9*c* is introduced into the positive motion cam groove 4*b* of the thread trimmer positive motion cam 4 to engage therein from the tip open end portion 4*d* thereof by the driving means 5 until the projection 9*c* of the thread trimming positive motion bracket 9 is disengaged from the positive motion cam groove 4*b*.

With the arrangement of the thread trimming device set forth above, for example, an operator stops the operation of the sewing machine by operating a pedal after the completion of a series of sewing operations so that the needle stops at the position adjacent to the lower dead point thereof. Successively, the driving means moves the thread trimmer positive motion bracket in the axial direction of the guide shaft so as to introduce the projection of the thread trimmer positive motion bracket into the tip open end portion of the positive motion cam groove of the thread trimmer positive motion cam to engage the same therein. At the same time, the projection of the thread trimmer lever engages the cam groove of the thread trimmer can and moves therealong as the thread trimmer lever moves in the axial direction of the guide shaft so that the thread trimmer lever turns. As a result, the movable knife coupled to the thread trimmer lever by way of the link mechanism is moved to cut the sewing threads cooperating with the fixed knife.

Since the projection of the thread trimmer positive motion bracket does not come out of the positive motion cam groove of the thread trimmer positive motion cam which rotates together with the hook driving shaft, the projection of the thread trimmer lever is kept to engage in the cam groove of the thread trimmer cam, so that the movable and fixed knives cut the sewing threads in cooperation with each other with certainty. Moreover, since the projection of the thread trimmer lever is kept to engage in the cam groove of the thread trimmer cam by the function of the thread trimmer positive motion cam, the driving means can be stopped at any time after the projection of the thread trimmer positive motion bracket engages the positive motion cam groove of the positive motion cam.

When the projection of the thread trimmer positive motion bracket is released from the positive motion cam groove of the thread trimmer positive motion cam by the rotation of the hook driving shaft, the thread trimmer positive motion bracket, which is forced to return (to its rest position), is disengaged from the thread trimmer positive motion cam so that the thread trimmer cam lever is also disengaged from the thread trimmer cam. Thus the thread trimming is completed.

PREFERRED EMBODIMENT OF THE INVENTION

An embodiment of the present invention will be described hereinafter.

FIGS. 1 to 8 show an embodiment of the present invention. In the figure, denoted at 1 is a hook driving shaft 1 of a sewing machine which rotates in synchronism with the arm shaft thereof, not shown, and a thread trimmer cam 2 and a thread trimmer positive motion cam 4 are coaxially fixed to the hook driving shaft 1. The thread trimmer cam 2 having a cam groove 2*a* on the outer periphery thereof for reciprocating a movable knife 3 and the thread trimmer positive motion cam 4 having a positive cam groove 4*b* at a portion of the side surface 4*a* thereof are always rotating during the operation of the sewing machine.

Figure 2:
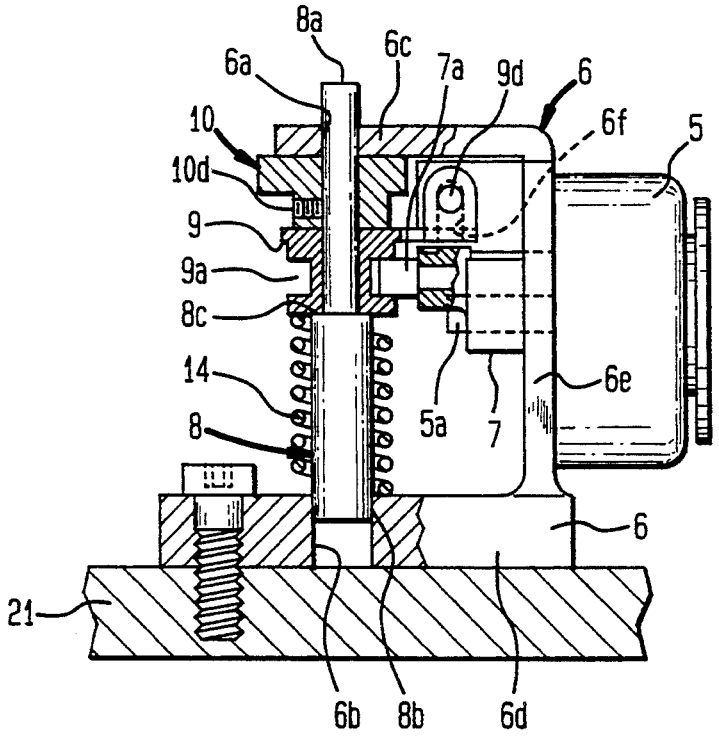
FIG. 2 is a cross-sectional view of the thread trimming device in FIG. 1 cut along a line II—II.

Denoted at 5 is a rotary solenoid serving as a driving means, which is fixed to the outer side surface of a connecting piece 6*e* of a U-shaped bracket 6 mounted on the sewing machine bed 21 as illustrated in FIG. 2. A swinging crank 7 having a pin 7*a* fixed at the other end thereof is fixed to the rotary shaft 5*a* of the rotary solenoid 5. The pin 7*a* is decentered relative to the rotary shaft 5*a* of the rotary solenoid 5 by a given amount.

Denoted at 8 is a guide shaft which is vertically slidably guided by guiding holes 6*a* and 6*b* formed in the confronting supporting pieces 6*c* and 6*d* of the aforementioned bracket 6 and which has a stepped surface 8*c* between the small diameter portion 8*a* thereof engaging the guiding hole 6*a* and the large diameter portion 8*b* thereof engaging the other guiding hole 6*b*. The thread trimmer positive motion bracket 9 and the boss of the thread trimmer lever 10 are successively fit on the small diameter portion 8*a* of the guide shaft 8 until the same is retained by the stepped surface 8*c* and thereafter the thread trimmer lever 10 is fixed to the small diameter portion 8*a* of the guide shaft 8 by a screw 10*d*. The thread trimmer lever 10 is rotatable together with the guide shaft 8 about the axis thereof. The guide shaft 8 is pressed upward by a spring 14 compressedly interposed between the lower surface of the boss of the thread trimmer positive motion bracket 9 and the supporting piece 6*d* so as to retain the same by way of the thread trimmer lever 10 fixed thereto by the supporting piece 6*c* under normal conditions.

Figure 1:
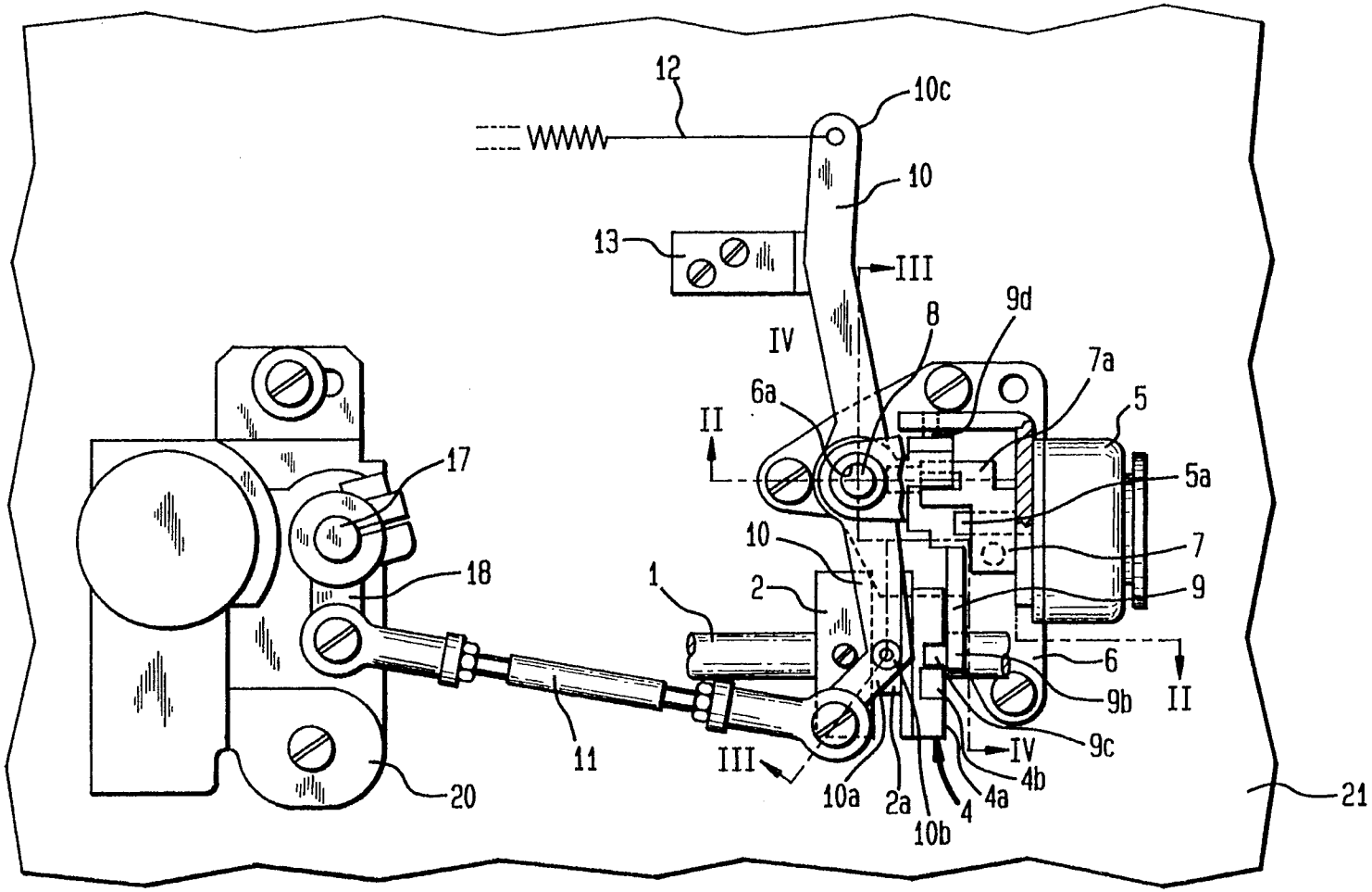
FIG. 1 shows a thread trimming device for a sewing machine according to an embodiment of the present invention as viewed from the back side.
Figure 3:
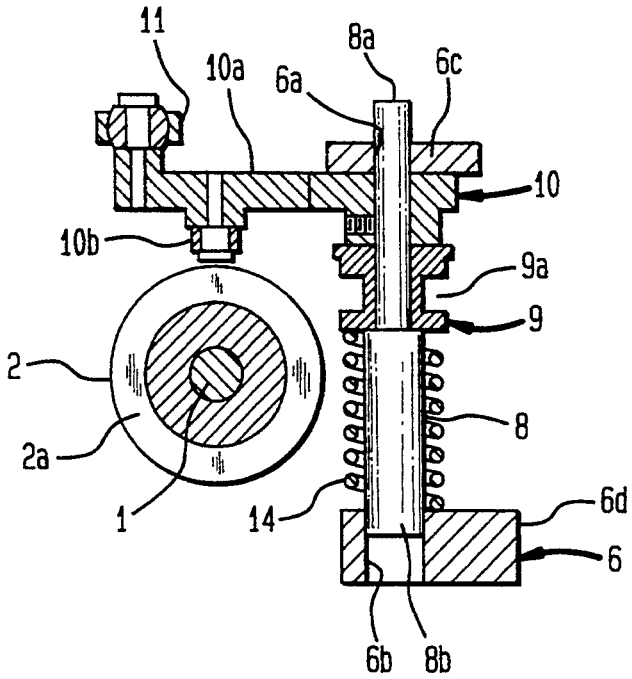
FIG. 3 is a cross-sectional view of the thread trimming device in FIG. 1 cut along a line III—III.

The thread trimmer lever 10 comprising a cam roller 10*b* at an end portion 10*a* thereof, the cam roller 10*b* projecting to engage in the cam groove 2*a* of the thread trimmer cam 2 when the threads are cut as illustrated in FIG. 3, is rotatably coupled to one end portion of the driving rod 11 at the portion thereof adjacent to the cam roller 10*b* and is always forced to turn counterclockwise by a tension spring 12 at the other end portion 10*c* thereof as illustrated in FIG. 1 so as to be in contact with and be stopped by a stopper 13 fixed to the sewing machine bed 21 under normal conditions.

The driving rod 11 reciprocates substantially in the axial direction thereof when the thread trimmer bracket 10 is turned about the axis of the guide shaft 8 with the cam roller 10*b* engaging in the cam groove 2*a*. It is a matter of course that the cam groove 2*a* of the thread trimmer cam 2 is formed in such a way as to allow the thread trimmer lever 10 to turn away from the stopper 13.

Figure 4:
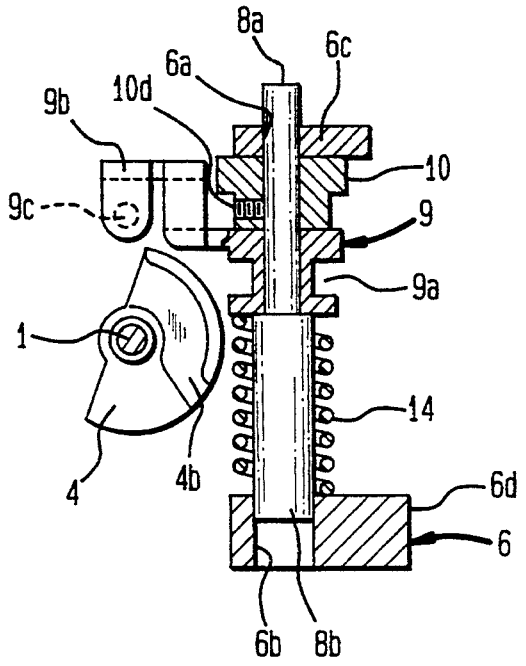
FIG. 4 is a cross-sectional view of the thread trimmer device in FIG. 1 cut along a line IV—IV.

A groove 9*a* in which a pin 7*a* of the swinging crank 7 engages is formed on the outer periphery of the boss which engages the guide shaft 8 of the thread trimmer positive motion bracket 9 as illustrated in FIG. 2 and a following pin 9*c* which engages in the positive motion cam groove 4*b* of the thread trimmer positive motion cam 4 when the threads are cut is fixed to one end portion 9*b* thereof as illustrated in FIG. 4. The thread trimmer positive motion bracket 9 is provided in such a way as to be able to move only in the axial direction of the guide shaft 8. Accordingly, a guide pin 9*d* provided on the other end portion of the thread trimmer positive motion bracket 9 is inserted into a vertical long guide groove 6*f* (refer to FIG. 2) so as to allow the thread trimmer positive motion bracket 9 to move vertically and restrain the same from turning about the axis of the guide shaft 8. As the thread trimmer positive motion bracket 9 is pushed up by the spring 14 and is retained by the supporting piece 6*c* by way of the thread trimmer lever 10, the following pin 9*c* is disengaged from the positive motion cam groove 4*b* of the thread trimmer positive motion cam 4.

Figure 7:
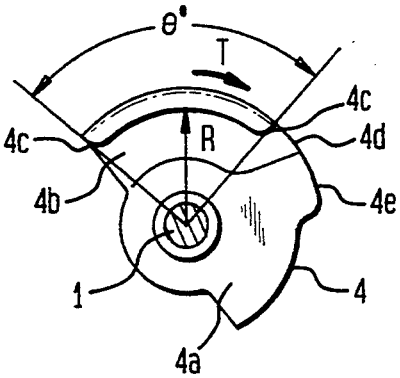
FIG. 7 is a side view of a thread trimmer positive motion cam in FIG. 1.

The positive motion cam groove 4*b* of the thread trimmer positive notion cam 4 provided on the side surface 4*a* thereof is formed along a circular arc having a radius R and an angle of circumference $\theta$ relative to a center at the hook driving shaft 1 and is subjected to chamfering 4c at the tip open end portion 4d thereof which is exposed to the outer periphery of the thread trimmer positive motion cam 4 for smoothly introducing the following pin 9c into the positive motion cam groove 4b of the thread trimmer positive motion cam 4 as illustrated in FIG. 7. An adjoining surface portion 4e having the same curvature is formed in front of the tip open end portion 4d of the positive motion cam groove 4b in the rotating direction T on the outer periphery of the thread trimmer positive motion cam 4 so as to be able to introduce the following pin 9c which contacts the adjoining surface portion 4e earlier than the tip open end portion 4d thereinto.

Figure 5:
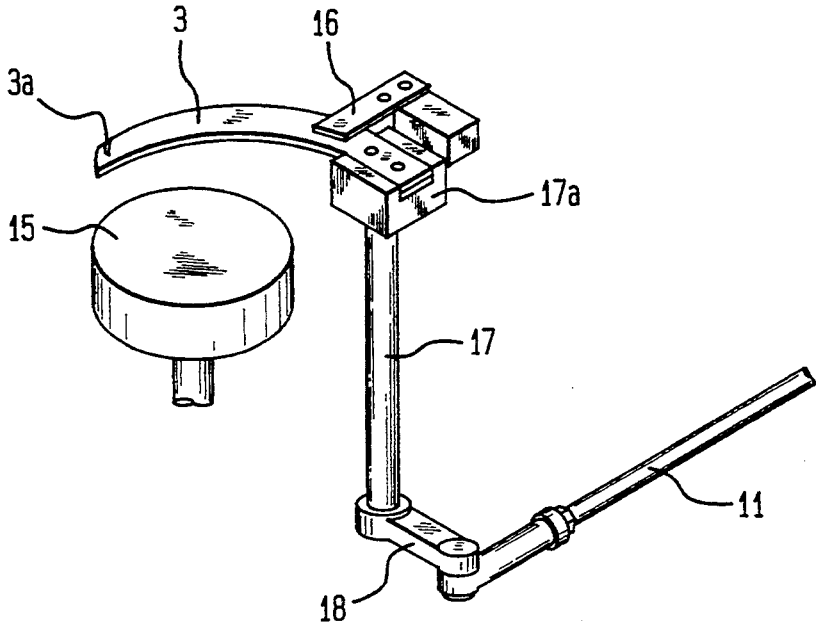
FIG. 5 is a perspective view showing the arrangement of the movable knife in FIG. 1.
Figure 6:
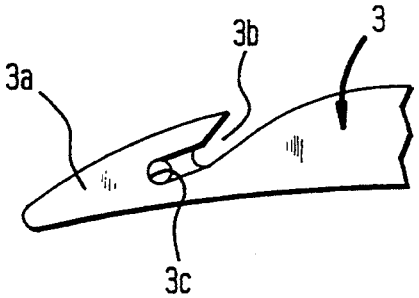
FIG. 6 is an enlarged view showing a main part of the movable knife in FIG. 1.

Denoted at 15 in FIG. 5 is a well-known hook, which forms a lock stitch in cooperation with a needle, not shown, vertically reciprocating through a throat plate, not shown, mounted on the sewing machine bed 21. The movable knife 3 is arranged adjacent to the hook 15. The movable knife 3 comprising a loop spreading portion 3a, threads pulling portion 3b and a blade portion 3c at the tip end thereof as illustrated in FIG. 6 is fixedly mounted on one end portion 17a of a movable knife driving shaft 17 at the base end portion thereof. The movable knife driving shaft 17 is rotatably supported by a hook saddle 20 (refer to FIG. 1) mounted on the sewing machine bed 21 at one end thereof, and one end of a driving crank 18 is fixed to the other end thereof. The other end of the driving crank 18 is rotatably coupled to the other end of the driving rod 11 by a pin. The movable knife driving shaft 17, the driving crank 18 and the driving rod 11 constitute a link mechanism which couples the movable knife 3 to the thread trimmer lever 10.

The cam groove 2a of the thread trimmer cam 2 is formed in a shape which is capable of reciprocating the movable knife 3 by way of the driving rod 11, the driving crank 18 and the movable knife driving shaft 17 by the thread trimmer lever 10 turned by the thread trimmer cam 2. The movable knife 3 which is operated by way of the driving rod 11 inserts the loop spreading portion 3a thereof into a looped needle thread formed by the hook 15 during the operation of thread trimming to pull the needle and bobbin threads at the thread putting portion 3b thereof. The movable knife 3 cuts the sewing threads composed of the needle and bobbin threads in cooperation with the fixed knife 16 provided adjacent thereto. The driving rod 11 can change the distance between the thread trimmer lever 10 and the driving crank 18 by adjusting the axial length thereof.

The function of the thread trimming device according to the embodiment set forth above will be described hereinafter.

When the operator stops the operation of the sewing machine by a given pedal operation after the completion of a series of sewing operations, a needle position signal is supplied to the control circuit of a motor, not shown, for stopping the needle at a given position so as to stop the needle at a position (point A in FIG. 8) adjacent to the lower dead point thereof.

Figure 8:
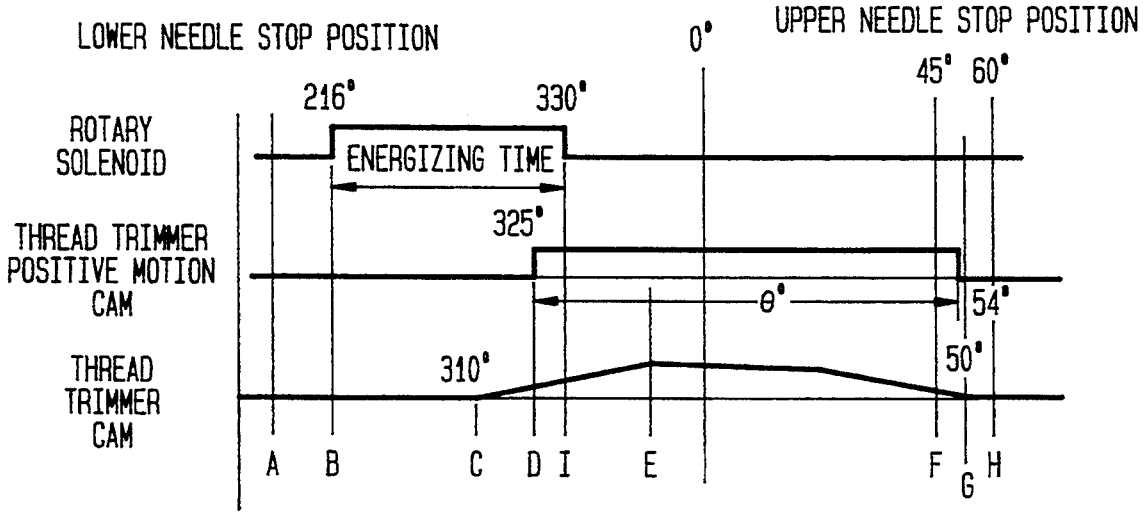
FIG. 8 is a timing chart showing the function of the thread trimming device in FIG. 1.
Figure 9:
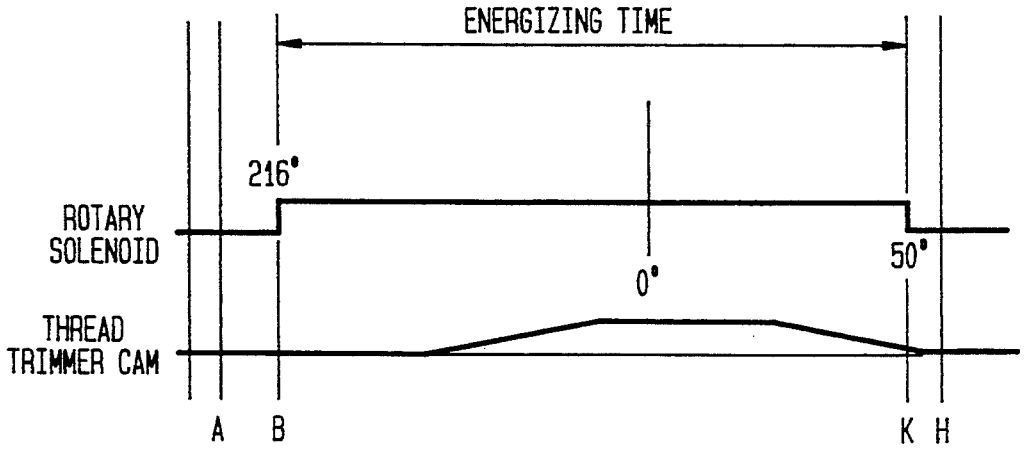
FIG. 9 is a timing chart showing the function of a conventional thread trimming device.

Then the operator operates the pedal to let the sewing machine to perform the thread trimming, when the sewing machine starts to rotate at a low speed and the rotary solenoid operates forward upon reception of the thread trimming signal (point B in FIG. 8).

The swinging crank 7 the pin 7a of which engages in the groove 9a is turned by the forward operation of the rotary solenoid 5 so as to push down the thread trimmer positive motion bracket 9, the guide shaft 8 and the thread trimmer lever 10 against the resilience of the spring 14. As a result, the cam roller 10b supported by the thread trimmer lever 10 fixed to the guide shaft 8 engages in the cam groove 2a of the thread trimmer cam 2, and at the same time the following pin 9c fixed to the thread trimmer positive motion bracket 9 lowers to engage in the positive motion cam groove 4b of the thread trimmer positive motion cam (point B in FIG. 8) That is, the following pin 9c of the thread trimmer positive motion bracket 9 enters the positive motion cam groove 4b from the tip open end portion 4d thereof on the thread trimmer positive motion cam 4. Since the chamfering 4c is formed around the tip open end portion 4d, the following pin 9c smoothly enters the positive motion cam groove 4b.

Accordingly, the cam roller 10b supported by the thread trimmer lever 10 moves along the cam groove 2a of the thread trimmer cam 2 so as to turn the thread trimmer lever 10 together with the guide shaft 8 about the axis thereof to thereby turn the movable knife driving shaft 17 by way of the driving rod 11 and the driving crank 18. As a result, the movable knife 3 attached to the end portion 17a of the movable knife driving shaft 17 is turned forward so that the loop spreading portion 3a at the tip end of the movable knife 3 enters a looped needle thread, not shown, which has been caught by the hook 15 (points C to E in FIG. 8).

At that time, the thread trimmer positive motion cam 4 coaxially fixed to the thread trimmer cam 2 is also turned and the following pin 9c of the thread trimmer positive motion bracket 9 moves along the positive motion cam groove 4b which has a circular arc shape having the center thereof at the hook driving 1, a radius of R and a given angle of circumference $\theta$. In this way, after the following pin 9c enters and engages in the positive motion cam groove 4b of the thread trimmer positive motion cam 4 (after passing point D in FIG. 8), the rotary solenoid 5 can be deenergized at any time (point I in FIG. 8). The rotary solenoid 5 is energized during the time between point B when it starts operation and point I when it stops operation in FIG. 8.

As mentioned above, the thread trimmer positive motion bracket 9 maintains engagement with the thread trimmer positive motion cam 4 while the latter turns for the angle of circumference $\theta$ which is defined by the positive motion cam groove 4b thereof, during which the guide shaft 8 is pushed down by a given length with certainly, so that the cam roller 10b of the thread trimmer lever 10 fixed to the guide shaft 8 maintains engagement with the cam groove 2a of the thread trimmer cam 2 with certainly until the phase of completion of the thread trimming defined by the positive motion cam groove 4b of the thread trimmer positive motion cam 4. During this period (concretely point E in FIG. 8), the movable knife 3 moves backward along the cam groove 2a to cut the sewing threads caught by the thread pulling portion 3b thereof as the blade portion 3c thereof passes under the fixed knife 16 (point F in FIG. 8).

When the following pin 9c of the thread trimmer positive motion bracket 9 is disengaged from the positive motion cam groove 4b of the thread trimmer positive motion cam 4 by the turning of the lower shaft 1, the thread trimmer positive motion bracket 9 and the thread trimmer lever 10 are pushed up by the resilience of the spring 14 to the original positions thereof and consequently the cam roller 10b of the thread trimmer lever 10 comes out of the cam groove 2a of the thread trimmer cam 2 to return to the original position (point G in FIG. 8). As the thread trimmer positive motion bracket 9 returns to the upper home position, the swinging crank 8 which engages the groove 9*a* at the pin 7*a* thereof also returns to the original position.

Thereafter, the arm shaft of the sewing machine stops when the thread take-up lever is positioned adjacent to the maximum height (point H in FIG. 8). The numerals followed by "°" in FIG. 8 represent the turning angles of the arm shaft of the sewing machine.

Although the thread trimmer cam 2 and the thread trimmer positive motion cam 4 are composed of different pieces and are fixed to the lower shaft 1 respectively according to the embodiment set forth above, it is a matter of course that they can be formed in one piece. Moreover, the thread trimmer lever 10 can be rotatably supported by a supporting shaft other than the guide shaft 8 so long as it is interlocked with the movement of the thread trimmer positive motion bracket 9 in the axial direction of the guide shaft 8 and is rotatably supported on the sewing machine bed. Furthermore, it is possible to replace the rotary solenoid 5 by a solenoid system for normally shuttling the rod to directly push or pull the thread trimmer positive motion bracket 9 so as to move the same in the axial direction of the guide shaft.

As understood from the description set forth above, the thread trimming device according to the present invention can set the time of completion of the thread trimming by the positive motion cam groove of the thread trimmer positive motion cam independently of the driving means, so that the thread trimming timing of the thread trimming device can be adjusted with ease and certainty.

Furthermore, since the driving means can terminate driving at any time after the thread trimmer positive motion bracket engages in the positive motion cam groove of the thread trimmer positive motion cam, instead of just before the completion of the thread trimming as in the prior art, the operating time of the driving means can be remarkably reduced to economize energy.

What is claimed is:

1. In combination with a sewing machine having a bed with a throat plate attached thereto, a rotatable arm shaft and a guide shaft mounted on the side of the bed, a needle which is vertically reciprocated through said plate, a stitch forming hook cooperating with the needle; a movable first knife and a fixed second knife;

a hook driving shaft disposed under said bed and coupled to the arm shaft to rotate in synchronism therewith;

a thread trimmer first cam having a cam surface and coaxially secured to the hook shaft;

a thread trimmer positive motion second cam having a cam surface and coaxially secured to the hook shaft;

a thread trimmer positive motion bracket supported by and axially movable along said guide shaft, said bracket having a projection engageable with the cam surface of the second cam;

a thread trimmer lever having a projection engageable with the cam surface of the first cam, said lever being rotatably supported on the side of the bed and coupled to said bracket to move therewith in the axial direction along the guide shaft;

a link mechanism coupling the first knife to said lever so that the first knife cuts sewing threads in cooperation with the second knife; and driving means for moving the bracket along the axial direction of said shaft.

* * * * *